United States Patent [19]

Runyon

[11] 4,145,850

[45] Mar. 27, 1979

[54] FOLDING MODULAR BUILDING STRUCTURE

[76] Inventor: John F. Runyon, 91 Kent St., #4, St. Paul, Minn. 55102

[21] Appl. No.: 879,073

[22] Filed: Feb. 21, 1978

Related U.S. Application Data

[63] Continuation-in-part of Ser. No. 397,765, Sep. 17, 1973, Pat. No. 4,074,477.

[51] Int. Cl.[2] ..... E04B 1/32

[52] U.S. Cl. ..... 52/71; 52/86; 52/DIG. 10

[58] Field of Search ..... 52/86, 81, 83, DIG. 10, 52/71

[56] References Cited

U.S. PATENT DOCUMENTS

| | | | |
|---|---|---|---|
| 3,325,958 | 6/1967 | Moore | 52/71 |
| 3,374,588 | 3/1968 | Alfrey | 52/86 |
| 3,445,970 | 5/1969 | Nelson | 52/81 |
| 3,524,288 | 8/1970 | Coppa | 52/71 |
| 3,656,267 | 4/1972 | Engle | 52/86 |
| 3,894,352 | 7/1975 | Hooker | 52/86 |
| 4,074,477 | 2/1978 | Runyon | 52/86 |

FOREIGN PATENT DOCUMENTS

| | | | |
|---|---|---|---|
| 1340142 | 9/1963 | France | 52/86 |
| 2255434 | 7/1975 | France | 52/86 |

*Primary Examiner*—Price C. Faw, Jr.
*Assistant Examiner*—Henry E. Raduazo
*Attorney, Agent, or Firm*—Burd, Braddock & Bartz

[57] ABSTRACT

A folding dome-like modular building structure composed of 48 flexibly interconnected equal right isosceles triangles. Each building structure is formed from a series of four flexibly connected modules of 12 triangles each. The modules are connected in alternating right and left-handed mirror image sequence. Each triangle may be a rigid panel or an open space enclosed by struts or panel edges. The structure may be formed in part from struts and in part from panels. It may be an open or partially open framework or it may be enclosed by fabric or film supported over or suspended from the framework.

10 Claims, 13 Drawing Figures

FOLDING MODULAR BUILDING STRUCTURE

This application is a continuation-in-part of my copending application Ser. No. 397,765, filed Sept. 17, 1973, now U.S. Pat. No. 4,074,477, issued Feb. 21, 1978.

BACKGROUND OF THE INVENTION

1. Field of the Invention

This invention is directed to folding dome-like modular building structures for the construction of buildings without internal supporting pillars or other structural supports which form interior obstructions. Because of the ease with which the buildings are assembled and disassembled, structures built according to the present invention are especially adapted for such uses as temporary shelters, storage buildings, exhibition buildings for use at fairs, trade shows, and the like, etc.

In my copending application, there are disclosed and claimed building structures formed from repeating alternating mirror-image forms of basic mathematically determinate structural modules. As in the present invention, each structural module of that invention is comprised of a plurality of rigid structural components, such as struts or panels or combinations of struts and panels, flexibly connected to adjoining components. Each structural module may be regarded as being limited by two planes defining the opposite sides of each module.

The structural components of the modules are flexibly connected such that any two adjoining components considered by themselves are free to pivot with respect to each other without torque or moment transmitting ability, either as a result of point hinge connection or linear hinge connection. Those parts of the components lying in the planes defining the limits of each module approximate a curve. The parts of the components lying in the planes are constrained against moving outside of the planes. Components are connected such that the module forms a mathematically determinate structure when subject to like constraints. In the total structure, each module constrains components of its adjacent modules from moving outside the limit planes. Adjacent modules are flexibly connected, that is, any two adjoining components of adjoining modules, considered by themselves, are connected so that they are free to pivot with respect to each other, just as any two adjoining components within the module. The present invention is directed to a specific form of the earlier invention.

2. The Prior Art

Nelson U.S. Pat. No. 3,346,998 discloses structures formed exclusively of flat paneled right triangular building components. However, the building components of Nelson are restricted to panels. Although right triangles, they are not isosceles triangles. Neither are they identical, but of two sizes, the hypotenuse of the smaller sized panel being equal in length to the long right angle leg of the other panel.

Alfrey et al. U.S. Pat. No. 3,374,588 discloses modular curved structures formed from a plurality of unsymmetrical or non-isosceles right triangular panels.

Other patents show structures formed of triangular components which are defined as panels, or by rods or struts, but which are non-isosceles right triangles, or isosceles non-right triangles, or non-isosceles non-right triangles, or combinations thereof in the same or different sizes.

SUMMARY OF THE INVENTION

Broadly stated, the present invention is directed to a folding modular building structure comprised of four flexibly interconnected structural modules. Each of the modules is comprised of a plurality of hinged structural elements defining 12 equal sized right isosceles triangular components. Each of the triangular components is a flat right isosceles triangle formed from a rigid sheet or panel, or a series of rigid struts or rods defining a right isosceles triangle, or a combination of panel edges and struts or rods. Each of the modules, if laid flat, defines a trapezoid. The hypotenuses of the triangles forming the trapezoid are parallel defining a long base and a short base. Isosceles sides of the triangles define the two non-parallel sides of the flat trapezoidal module.

There are two right handed modules and two left handed modules. The modules are connected along their parallel bases and sides in repeating right and left handed mirror image form with each right handed module being adjacent to a left handed module. Thus, the components forming the short base and two sides of the trapezoidal module are connected to the components forming the short base and two sides of the next adjacent trapezoidal module. The components defining the long base of that module are connected to the corresponding components defining the long base of the next module, etc.

In the assembled structure, a limit plane is defined by the boundary between each adjacent pair of modules. Thus, there are three boundary limit planes lying between four modules. The endmost edges of the two endmost modules lie in a pair of base planes, which may be coplanar, such as the ground or a flat foundation. Each plane is equally displaced from the next. In the preferred embodiment, as illustrated, the hypotenuses of the triangular components defining the long bases of the trapezoidal modules lie in the first and third planes. The hypotenuses of the triangular components defining the short bases of the trapezoidal modules and the sides of the triangular components defining sides of the trapezoidal modules lie in the middle or second limit plane, and in the base planes.

The parts of the triangular components lying in the planes approximate a curve. Joining parts lying in the planes are serially connected. Means are provided for constraining the parts of the components lying in the planes from moving outside the planes, whereby a mathematically determinate structure is formed.

In the preferred embodiment, the building structure may be covered by a single sheath formed from two hexagonal sheets of fabric or film, each of area twice that of a trapezoidal module laid flat, and seamed together along three edges corresponding to the short base and two sides of a trapezoid. This sheath formed of flexible sheet or film material conforms to the building contour.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
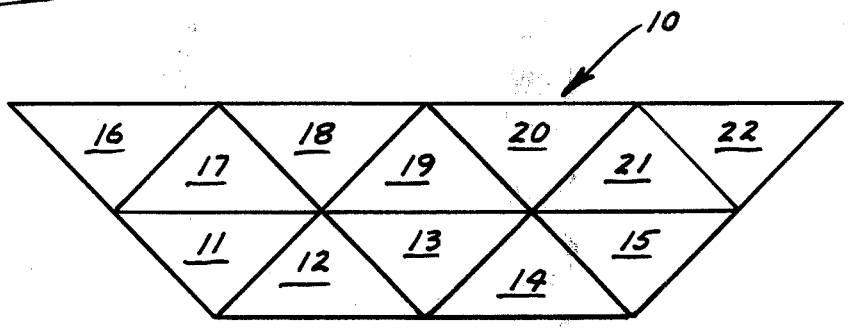
FIG. 1 shows a single module skeleton laid flat.
Figure 8:
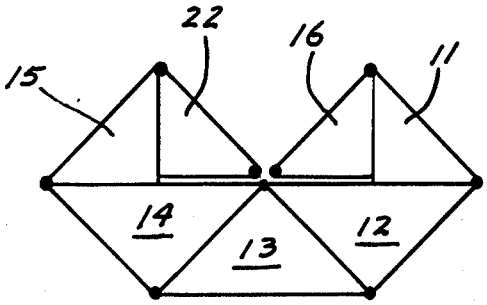
FIG. 8 shows the folded components of FIG. 7 in schematic plan view.

Referring now to the drawings, FIG. 1 (sheet 2) shows a single module, indicated generally at 10, in schematic skeleton form laid flat. It will be seen that the flat module forms a trapezoid consisting of 12 equal sized right isosceles triangles 11–22 with all hypotenuses parallel. Each of the modules is formed from a plurality of hinged rigid structural elements defining the triangular components. The structural elements may be relatively thin, flat, rigid, triangular panels composed, for example, of metal sheeting, hardborad, fiberboard, synthetic resinous material such as transparent methyl methacrylate, glass fiber reinforced polyvinyl chloride, polystyrene, or the like.

Each triangular component is flexibly connected to its next adjacent triangular components. Where the components are in the form of panels, the edge-to-edge flexible connections are made by hinges such as piano hinges extending the length of each side of the triangles, or spaced apart shorter hinges. Where the panel material is relatively lightweight, the hinges may be formed from flexible pressure-sensitive or other adhesive tapes.

The triangular components may also be formed from rigid struts or rods. Preferably, the struts are in the form of rigid tubes, such as aluminum, for example, or wooden dowels or rods, or the like. Where the modules are formed from struts, the triangular components are flexibly connected together point-to-point by means of hinged joint assemblies. Exemplary hinge joints are described and claimed in my copending application Ser. No. 744,984, filed Nov. 26, 1976, and now U.S. Pat. No. 4,111,574, issued Sept. 5, 1978. Another form of hinge is shown in Cook U.S. Pat. No. 3,148,539. Each module may be formed from a combination of structural elements such that some of the triangular components are panels, some are defined in part by panel edges and struts, and some are formed entirely by struts. Struts and panels connected at only one point (point-to-point) are fastened with joints providing three degrees of rotational freedom.

In assembling a building, four identical modules are flexibly connected together, two in right hand configuration and two in mirror-image left hand configuration. Thus, a module 10 is connected to a similar module 10A in mirror image along the long bases of the trapezoidal modules when laid flat. The hypotenuses of the triangular components 16 and 18 of both modules share a common edge with the hypotenuses of triangular components 22 and 20, respectively, of the next module. A third module 10B is then assembled to module 10A in mirror image with the short bases and sides of the trapezoidal modules abutting such that triangular components 11, 12 and 16 of both modules share a common edge with triangular components 15, 14 and 22, respectively, of the next module. The fourth module 10C is again assembled in mirror image with module 10B along the long base.

Figure 2:
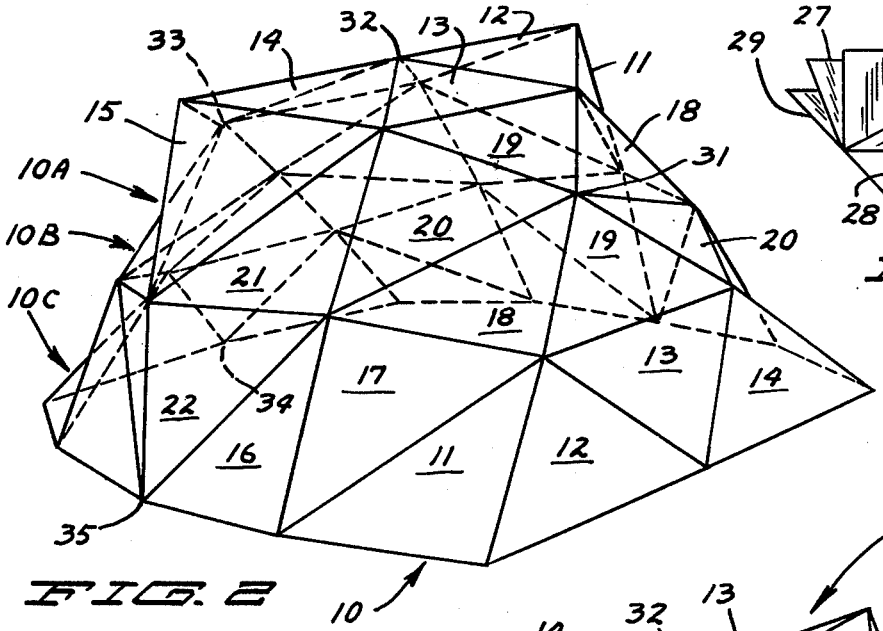
FIG. 2 shows an assembled structure composed of four module skeletons.

In FIGS. 2 through 10, the triangular components are shown as being closed, such as by opaque films or panels or other sheet material. Components on the far side of the structure of FIG. 2 are shown by broken lines. These broken lines have been omitted from other figures for clarity. Likewise, to minimize confusion and avoid needlessly cluttering the drawings, only the triangular components on the near side of the vertical limit plane are identified by numeral.

Figure 2A:
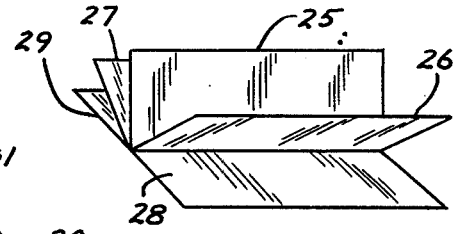
FIG. 2A shows the disposition of five boundary planes associated with the structure.

In FIG. 2, there is shown a full structure in the form of a dome-like skeleton of 48 right isosceles triangles, formed from four modules. The 48 triangles in the dome-like skeleton have a total of 78 sides, 26 of which are long and represent the hypotenuses of the triangles and 52 of which are shorter in length and represent the isosceles sides of the triangles. The limit planes are best seen by comparison of FIGS. 2 and 2A. The hypotenuses of the triangular components 12 and 14 of module 10A define a common edge with the hypotenuses of the triangular components 14 and 12, respectively, of module 10B. These common edges lie in the vertical limit plane 25. The sides of modules 10A and 10B lie in the same plane 25 with the edge of triangular component 15 of module 10A sharing an edge with triangle 11 of module 10B, triangle 22 of 10A sharing an edge with triangle 16 of 10B, triangle 11 of 10A sharing an edge with triangle 15 of 10B, and triangle 16 of 10A sharing an edge with triangle 22 of 10B.

The hypotenuses of the triangles 16, 18, 20 and 22 forming the boundary between modules 10 and 10A lie in limit plane 26. The hypotenuses of the same triangles forming the boundary between modules 10B and 10C lie in limit plane 27 equally spaced on the opposite side of the vertical plane. The hypotenuses of triangles 12 and 14 defining the short base of module 10 and the short sides of triangles 11 and 16 and 15 and 22 defining the sides of module 10 all lie in a base plane 28 spaced from plane 26 by the same distance that plane 26 is spaced from vertical plane 25. Similarly the same edges of module 10C lie in base plane 29 which is similarly spaced. In most instances, planes 28 and 29 will be coplanar being the plane at which the base of the structure is attached to a foundation or to the ground.

The parts are constrained to lie in their respective planes to form a rigid mathematically determinate structure by anchoring the components 11, 12, 14, 15, 16 and 22 of modules 10 and 10C, whose edges lie in the base planes 28 and 29, to the base surface. FIG. 2 shows the appearance of the dome-like structure with five vertices 30–34, one in each boundary plane, popped out to gain maximum inside space. If limit plane 25 is regarded as the longitudinal bisector of the structure, then it will be noted that all of the popped out vertices lie in a plane along the transverse bisector.

Figure 5:
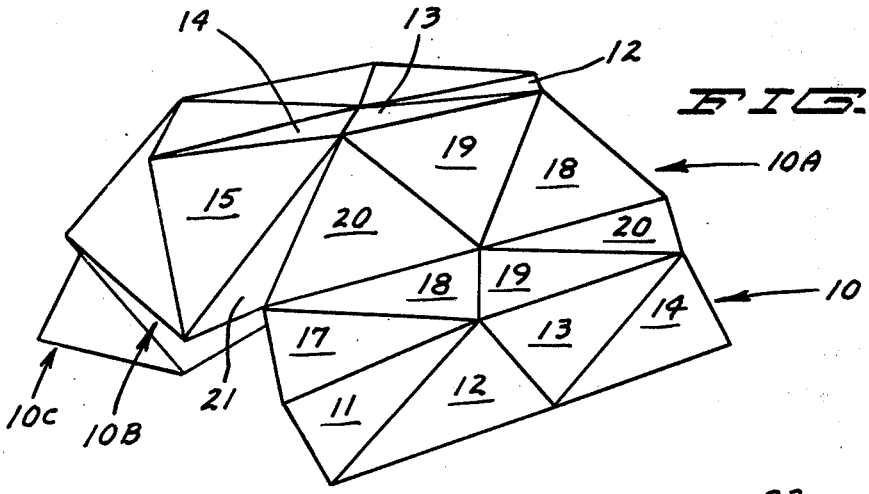
FIGS. 4 through 7 show the next successive folding steps in perspective view.
Figure 6:
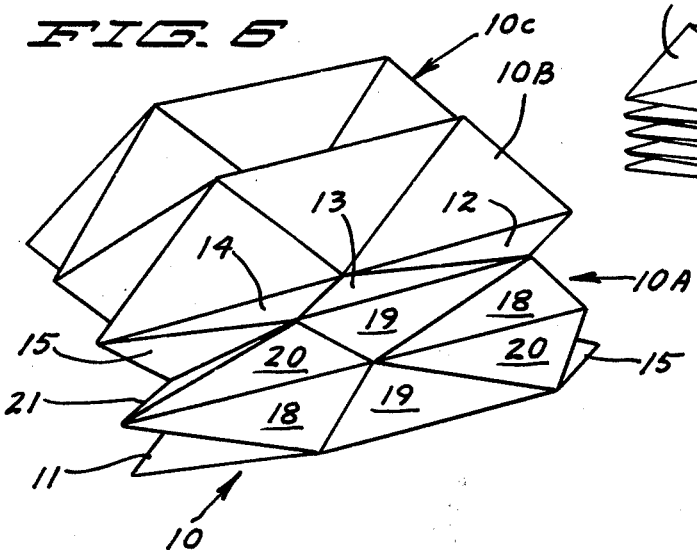
Figure 7:
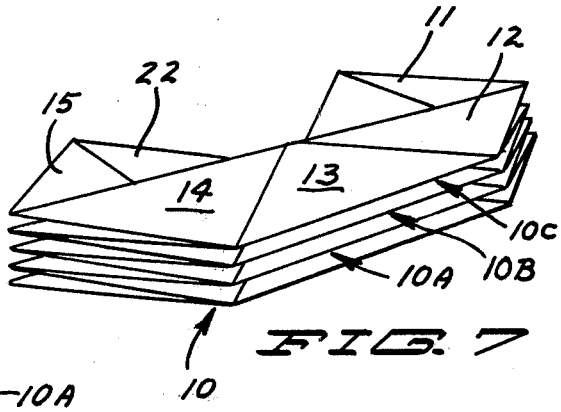
Figure 3:
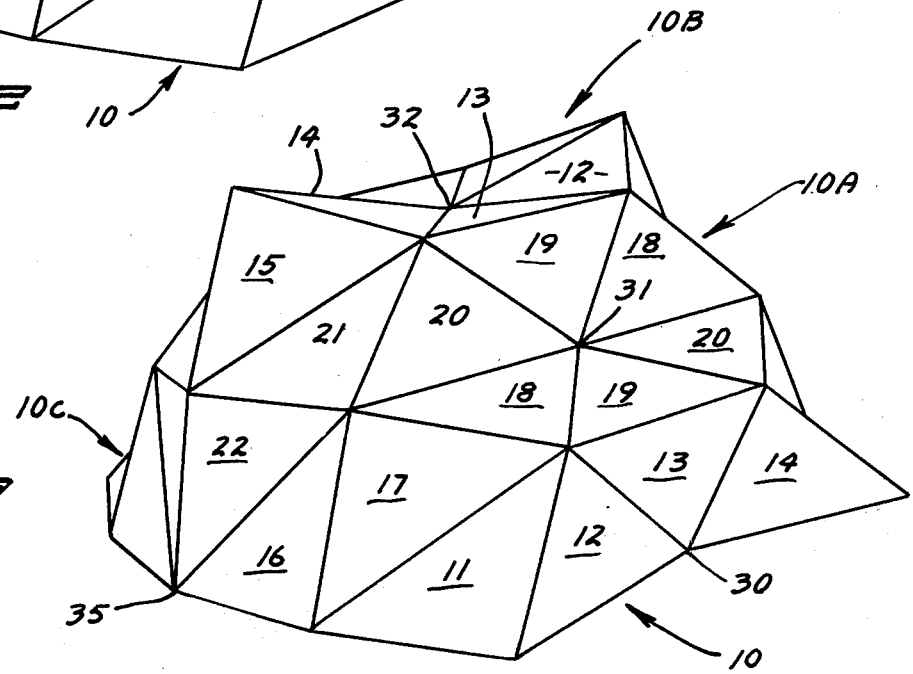
FIG. 3 shows the structure of FIG. 2 in the first stage of collapse for folding and disassembly.
Figure 4:
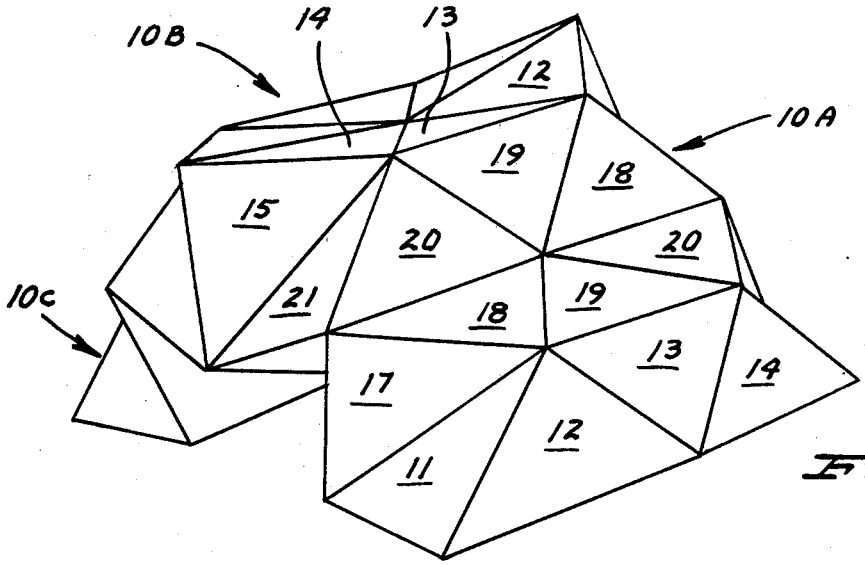

The structure has a pair of vertices 35 which lie in limit plane 25 at opposite ends of the structure where all four modules touch. The two joints at these vertices mark opposite poles of the structure for they lie on the line of intersection of the five limit planes 25–29. FIGS. 3 through 7 show how the building may be collapsed by folding. It will be understood, of course, that the structure is erected in the reverse fashion by unfolding. FIG. 3 shows the structure ready for folding with the vertices 30–34 pushed inwardly. To begin folding, the two poles marked by vertices 35 are pulled inwardly toward the center of the structure, as shown in FIGS. 4 and 5. The structure is then collapsed like an accordion, as shown in FIGS. 6 and 7. The folded shape is shown in schematic plan view in FIG. 8.

Figure 9:
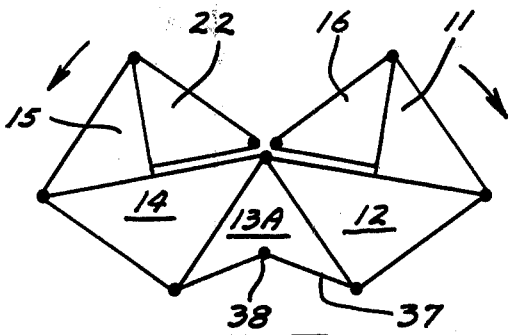
FIG. 9 is a similar schematic plan view showing how under certain circumstances the folded component package may be reduced further in size.
Figure 10:
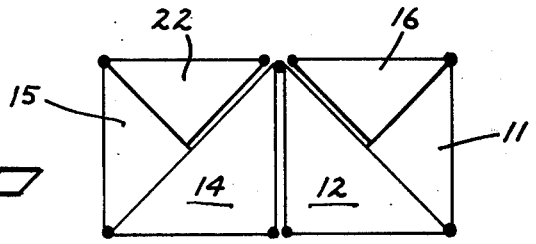
FIG. 10 is a similar schematic plan view showing the folded component package.

In FIG. 9, there is shown in schematic plan view a modified form of folded structure in which the element defining the common edge between triangular components 13 and 19 in each of the four modules is a strut 37 broken at its center by a locking hinge 38. Thus, it will be seen that triangle 13A can be eliminated by folding the opposite ends of the folded structure inwardly to an even more compact package, as shown in FIG. 10. The same results can be achieved by simply removing the four struts defining the common edges between triangular components 13 and 19.

Figure 11:
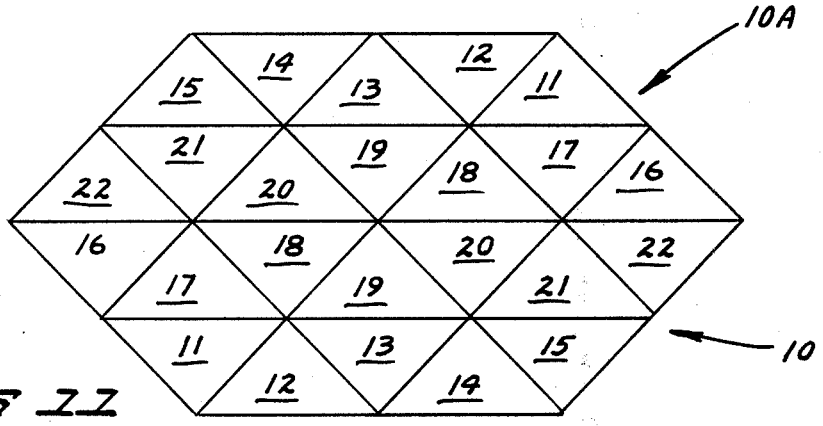
FIG. 11 is a schematic plan view showing another form into which the structure of FIG. 2 may be initially collapsed.
Figure 12:
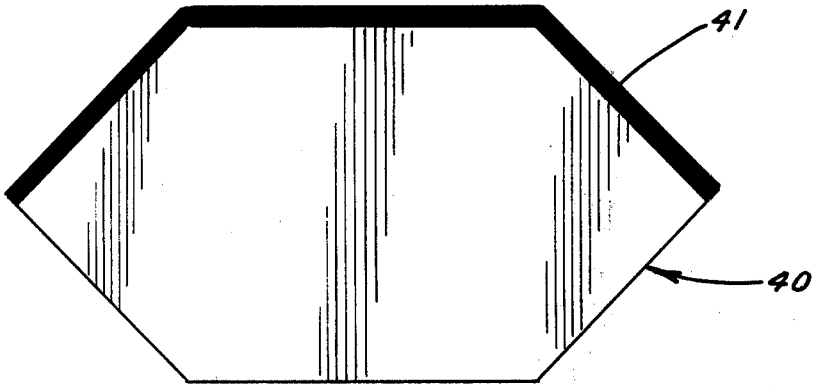
FIG. 12 is a plan view of a fabric cover or sheath for the structure.

If, instead of pulling the poles represented by vertices 35 inwardly to collapse the structure, those poles are pulled outwardly away from each other, then the structure of FIG. 2 may be collapsed to the shape of FIG. 11. FIG. 11 shows in plan view two layers of 24 triangles composed of two modules lying directly atop two other modules. From this it is readily seen that the structure of FIG. 2 may be covered by a sheath 40 of film or fabric, as seen in FIG. 12. Two layers of film or fabric in the shape of two assembled modules laid one layer directly atop the other are seamed together along the heavy black lines 41. It will be seen that the area of this fabric cover equals the 48 triangular areas of the modules in precisely the same configuration as the skeleton of the structure. Accordingly, the cover will fit closely over and conform to the outer surface of the erected structure. A similar skin made slightly smaller may be hung from the inside of the structure by appropriate tying means fastened to the structure at each vertex. For some purposes, it is desirable to provide both an outside and inside skin with air space in between for insulation.

Without deviating from the principles of the invention, the structure may be formed in any desired size dependent upon the size of the basic triangular components. Dependent upon the size of the structure, doors and windows may be cut in the rigid panels. Alternatively, struts or panels may be removed to form larger openings after the structure is unfolded, so long as the structural effects of removed or altered components are compensated by other means, such as tensioning cables or attachment to external supports.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A folding modular building structure comprised of four flexibly interconnected structural modules:
(A) each of said modules comprised of a plurality of hinged rigid structural elements defining twelve equal sized right isosceles triangular components,
(B) each of said modules, if laid flat, defining a trapezoid, the hypotenuses of the triangles forming the trapezoid being parallel, and
(C) said interconnected modules being disposed in repeating right and left-handed mirror-image form, each right-handed module being adjacent to a left-handed module.

2. A building structure according to claim 1 wherein said rigid structural elements are composed of linear strut-like elements flexibly connected at their ends point-to-point to like linear elements.

3. A building structure according to claim 1 wherein said rigid structural elements are composed of planar triangular panel-like elements flexibly connected point-to-point and edge-to-edge to like planar elements.

4. A building structure according to claim 1 wherein:
(A) said rigid structural elements are a combination of linear strut-like elements and planar triangular panel-like elements,
(B) adjacent strut-like elements are flexibly connected in point-to-point end connections,
(C) adjacent panel-like members are flexibly connected in edge-to-edge connection, and
(D) adjacent strut-like and panel-like elements are flexibly connected in point-to-point end connections.

5. A building structure according to claim 2 wherein the triangular spaces defined by the rigid strut-like elements are spanned by flexible sheet material supported by said strut-like elememts.

6. A building structure according to claim 5 wherein said sheet material comprises two like layers of flexible fabric or film, the area of each of said layers corresponding to that of two trapezoidal modules laid flat and connected along their long bases, said layers of sheet material being seamed along the edge corresponding to the short base and sides of a trapezoidal module.

7. A building structure according to claim 6 wherein said sheet material overlies said rigid structural elements.

8. A building structure according to claim 6 further characterized in that said sheet material is suspended within the structure from vertices of intersecting structural elements.

9. A building structure according to claim 1 wherein:
(A) said structure includes three intersecting boundary limit planes, one between each adjacent pair of modules, and a pair of intersecting base planes at the endmost edges of the two endmost modules,
(B) each plane is equally displaced from the next,
(C) the hypotenuses of the triangular components defining the long bases of the trapezoidal modules lie in the first and third limit planes,
(D) the hypotenuses of the triangular components defining the short bases and sides of the trapezoidal modules lie in the second limit plane and in the base planes,
(E) the parts of said triangular components lying in said planes approximate a curve,
(F) joining parts lying in said planes are serially connected, and
(G) means are provided for constraining the parts of said components lying in said planes from moving outside the planes.

10. A building structure according to claim 9 wherein said means for constraining the parts of said components lying in said planes from moving outside the planes comprise means for anchoring in the base planes the hypotenuses side of the triangular components defining the shorter bases and sides of the outermost pair of trapezoidal modules.

* * * * *

UNITED STATES PATENT AND TRADEMARK OFFICE

CERTIFICATE OF CORRECTION

PATENT NO. : 4,145,850

DATED : March 27, 1979

INVENTOR(S) : John F. Runyon

It is certified that error appears in the above–identified patent and that said Letters Patent are hereby corrected as shown below:

In the heading, --The portion of this patent subsequent to February 21, 1995 is disclaimed-- has been omitted.

Column 6, line 65, "side" should be --and sides--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*